US011149434B2

(12) United States Patent
Baron

(10) Patent No.: US 11,149,434 B2
(45) Date of Patent: Oct. 19, 2021

(54) METHOD FOR PRODUCING A CEILING ELEMENT AND CEILING FORMWORK

(71) Applicant: DOKA GMBH, Amstetten (AT)

(72) Inventor: Christoph Baron, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 16/635,914

(22) PCT Filed: Aug. 2, 2018

(86) PCT No.: PCT/EP2018/070921

§ 371 (c)(1),
(2) Date: Jan. 31, 2020

(87) PCT Pub. No.: WO2019/025513

PCT Pub. Date: Feb. 7, 2019

(65) Prior Publication Data

US 2020/0232213 A1 Jul. 23, 2020

(30) Foreign Application Priority Data

Aug. 2, 2017 (EP) ..... 17184436

(51) Int. Cl.
*E04G 11/48* (2006.01)
*E04B 5/36* (2006.01)
(Continued)

(52) U.S. Cl.
CPC ..... *E04B 5/36* (2013.01); *E04G 11/483* (2013.01); *E04B 2005/322* (2013.01);
(Continued)

(58) Field of Classification Search
CPC ..... E04G 11/38; E04G 11/48; E04G 11/483; E04G 11/486; E04B 5/17; E04B 5/32; E04B 5/36
See application file for complete search history.

(56) References Cited

U.S. PATENT DOCUMENTS 7,530,545 B2 * 5/2009 Gillespie ..... E04G 11/38 249/210
7,571,888 B2 * 8/2009 Arozena Bergaretxe ..... E04G 11/486 249/18

(Continued)

FOREIGN PATENT DOCUMENTS

CN 2367688 Y * 3/2000
CN 102587647 A * 7/2012 ..... E04G 17/00

(Continued)

OTHER PUBLICATIONS

ISA European Patent Office, International Search Report Issued in Application No. PCT/EP2018/070921, dated Sep. 10, 2018, WIPO, 5 pages.

*Primary Examiner* — Michael Safavi
(74) *Attorney, Agent, or Firm* — McCoy Russell LLP

(57) ABSTRACT

The invention relates to a ceiling formwork and a method for producing a ceiling element, comprising the following steps:

arranging two ceiling supports on a floor, connecting a first end region of a ceiling formwork frame to the two ceiling supports such that the ceiling formwork frame is arranged in an intermediate position inclined downward from the first end region in the direction of a second end region, connecting a lost ceiling plate to the ceiling formwork frame arranged in the intermediate position, pivoting the second end region of the ceiling formwork frame up, together with the lost ceiling plate, supporting the second end region of the ceiling formwork frame that has been pivoted up by at least one additional ceiling support and casting the ceiling element, together with the lost ceiling plate, on the ceiling formwork frame.

11 Claims, 11 Drawing Sheets

(51) Int. Cl.
*E04B 5/32* (2006.01)
*E04G 11/38* (2006.01)
*E04G 9/02* (2006.01)

(52) U.S. Cl.
CPC ..... *E04G 11/38* (2013.01); *E04G 11/486* (2013.01); *E04G 2009/028* (2013.01)

(56) References Cited

U.S. PATENT DOCUMENTS

| | | | | |
|---|---|---|---|---|
| 8,276,874 | B2 * | 10/2012 | Schwoerer | E04G 11/54 249/18 |
| 8,523,137 | B2 * | 9/2013 | Schworer | E04G 11/483 249/18 |
| 10,890,001 | B2 * | 1/2021 | Hollmann | E04G 9/05 |
| 2004/0075042 | A1 * | 4/2004 | Arozena Bergaretxe | E04G 11/486 249/210 |
| 2008/0031686 | A1 * | 2/2008 | Gillespie | E04G 11/48 403/322.1 |
| 2016/0244984 | A1 * | 8/2016 | Hollmann | E04G 9/05 |
| 2018/0334818 | A1 * | 11/2018 | Lenkin | E04G 11/50 |
| 2019/0010716 | A1 * | 1/2019 | Baron | E04G 25/065 |
| 2020/0173183 | A1 * | 6/2020 | Routh | E04G 9/02 |
| 2020/0332541 | A1 * | 10/2020 | Haeberle | E04G 25/065 |

FOREIGN PATENT DOCUMENTS

| | | | | | |
|---|---|---|---|---|---|
| CN | 204059954 | U | * | 12/2014 | |
| DE | 3323921 | A1 | * | 1/1985 | E04G 11/38 |
| DE | 202006003836 | U1 | * | 6/2006 | E04G 11/483 |
| DE | 102006015348 | A1 | * | 10/2007 | E04G 11/483 |
| DE | 102007021159 | B4 | * | 1/2009 | E04G 11/48 |
| DE | 102012211388 | A1 | * | 1/2014 | E04G 11/48 |
| EP | 0054131 | A1 | * | 6/1982 | E04G 11/486 |
| EP | 1375781 | A1 | | 1/2004 | |
| EP | 1384837 | A1 | | 1/2004 | |
| EP | 2679744 | A1 | * | 1/2014 | E04G 11/38 |
| EP | 2749713 | B1 | * | 12/2015 | E04G 11/486 |
| EP | 3121349 | B1 | * | 6/2018 | E04G 11/50 |
| EP | 3433449 | B1 | * | 8/2020 | E04G 11/48 |
| EP | 3702550 | A1 | * | 9/2020 | E04G 11/50 |
| FR | 2760482 | B1 | * | 6/1999 | E04G 11/48 |
| FR | 2957957 | A1 | | 9/2011 | |
| FR | 3017891 | A1 | * | 8/2015 | E04G 11/38 |
| WO | WO-02084051 | A1 | * | 10/2002 | E04G 11/486 |
| WO | WO-2007003400 | A1 | * | 1/2007 | E04G 11/483 |
| WO | 2013098158 | A1 | | 7/2013 | |
| WO | 2016177979 | A1 | | 11/2016 | |
| WO | WO-2019011885 | A1 | * | 1/2019 | E04G 25/061 |

* cited by examiner

METHOD FOR PRODUCING A CEILING ELEMENT AND CEILING FORMWORK

CROSS-REFERENCE TO RELATED APPLICATIONS

The present application is a U.S. National Phase of International Patent Application Serial No. PCT/EP2018/070921 entitled "METHOD FOR PRODUCING A CEILING ELEMENT AND CEILING FORMWORK," filed on Aug. 2, 2018. International Patent Application Serial No. PCT/EP2018/070921 claims priority to European Patent Application No. 17184436.8 filed on Aug. 2, 2017. The entire contents of each of the above-referenced applications are hereby incorporated by reference for all purposes.

TECHNICAL FIELD

The invention relates to a method for producing a ceiling element.

The invention further relates to a ceiling formwork for producing a ceiling element.

BACKGROUND AND SUMMARY

A ceiling formwork of this type for producing ceiling and floor slabs, with which a lost shuttering panel is used, is already known from WO 2016/177979 A1. In this prior art, first a number of ceiling supports are constructed, on which longitudinal and cross beams are supported. The lost shuttering panels with which the ceiling or floor slab is cast are placed onto this structure. The lost shuttering panels form a lower layer of the finished ceiling or floor slab. The use of lost shuttering panels provides many advantages, including, for instance, the higher quality of the surface, the simplification of subsequent work on the ceiling slab and the reduced effort for removing formwork. A disadvantage of the prior art, however, is the handling of the lost shuttering panels, which entails a certain safety risk.

Other types of frame structures for different uses, not for lost formworks, are also known from the prior art.

EP 1 384 837 A1 discloses a frame structure which can be hooked into holders on props and can be brought into an oblique intermediate position during construction.

FR 2 957 957 A1 discloses a frame structure with props, a frame and shuttering panels. During construction, the frame is first folded on one side at the props 55 and then upwards.

EP 1 375 781 A1 likewise discloses a frame structure consisting of an outer frame part and an inner frame part which can be pivoted relative to the outer frame part.

Accordingly, the object of the present invention consists in moderating or overcoming at least some disadvantages of the prior art. In particular, the invention aims to specify a method and a ceiling formwork with which the use of lost ceiling panels can be made simple and safe.

This object is achieved by a method according to Claim 1 and a ceiling formwork according to Claim 10. Preferred embodiments are specified in the dependent claims.

In the method according to the invention, at least the following steps are carried out:

arranging two ceiling supports on a floor, connecting a first end region of a ceiling formwork frame to the two ceiling supports such that the ceiling formwork frame is arranged in an intermediate position inclined downwards from the first end region in the direction of a second end region, connecting a lost ceiling panel to the ceiling formwork frame arranged in the intermediate position, pivoting up the second end region of the ceiling formwork frame together with the lost ceiling panel, supporting the second end region of the pivoted-up ceiling formwork frame with at least one further ceiling support, and casting the ceiling element together with the lost ceiling panel on the ceiling formwork frame.

The casting of the ceiling element can advantageously be prepared from the floor. The lost ceiling panel is arranged on the ceiling formwork frame while the ceiling formwork frame is arranged in the intermediate position inclined downwards towards the floor in the direction from the first to the second end region. When in the intermediate position, the ceiling formwork frame is easily accessible from the floor to attach the lost ceiling panel to the ceiling formwork frame. When in the intermediate position, the ceiling formwork frame is preferably arranged at an angle of at least 10 degrees, in particular at least 20 degrees, preferably at least 30 degrees, to a horizontal plane through the points at which the first end region of the ceiling formwork frame is connected to the ceiling supports. Only then is the second end region of the ceiling formwork frame, together with the lost ceiling panel arranged thereon, pivoted upwards from close to the floor and then supported with the at least one further ceiling support so that the ceiling formwork frame together with the lost ceiling panel is arranged in the (in particular horizontal) use position. This provides the essential advantage that, when the ceiling formwork is constructed from the floor, a closed working area is first created on the upper face of the lost ceiling panel, which area must only then be walked on by workers in order to carry out further work on the lost ceiling panel, for example providing reinforcements or laying lines. Occupational safety can be considerably improved thereby. In contrast to this, the lost ceiling panels in the prior art had to be arranged on formwork beams which were already in the horizontal use position. However, this required the workers to get on the formwork beams in order to arrange the lost ceiling panels from above on the ceiling formwork elements. During this, however, there were sometimes even large openings or gaps in the formwork structure, which could adversely affect occupational safety. In addition, protrusions of the panels beyond the edge of the formwork structure often entailed a hazard potential for the workers. The panels themselves could also be damaged by the protrusions. In contrast, the present method allows safe and simple production of ceiling elements with at least one lost ceiling panel, i.e. a ceiling panel remaining in the ceiling element. The ceiling element is produced by feeding concrete onto the lost ceiling panel. A ceiling element (or correspondingly a floor element) which can advantageously have a finished lower face is thus obtained. Accordingly, any subsequent work can be reduced. Furthermore, the removal of formwork for the preparation of the next casting process can be made easier. Cleaning of the formwork can also be made easier.

For the purposes of the present disclosure, the location and direction information such as "upper", "lower", "horizontal" and "vertical" relate to a horizontal use state of the ceiling formwork frame for casting the ceiling element. Of course, the ceiling formwork frame can however also be arranged inclined to the horizontal in order to produce an oblique ceiling element.

A . . . panel is preferably used as the lost ceiling panel. Preferably, the lost ceiling panel is produced from a material from the group consisting of plaster, wood, wood-compound material, plastic, steel, aluminium and/or a combination thereof. The lost ceiling panel can be strengthened with glass fibres, for example, or be reinforced.

In a preferred application, the lost ceiling panel comprises markings on the upper face (i.e. on the side facing away from the floor), which markings preferably show a line plan for the ceiling element, in order to facilitate the installation of lines such as electrical cables or pipes on the lost ceiling panel before concreting.

According to a preferred embodiment, the lost ceiling panel is placed into a holder of the ceiling formwork frame for connection to the ceiling formwork frame. In this embodiment, the lost ceiling panel can be connected to the holder of the ceiling formwork frame without tools when in the intermediate position. The holder preferably comprises a bearing face onto which the lost ceiling panel is placed. The bearing face preferably comprises in each case one section along two transverse sides and two longitudinal sides of a ceiling formwork frame which is rectangular when viewed from above. It is particularly preferred if the bearing face extends continuously along the two transverse sides and the two longitudinal sides of the ceiling formwork frame. Accordingly, a bearing running all the way round is provided for the lost ceiling panel. Advantageously, the lost ceiling panel does not protrude beyond the longitudinal sides and transverse sides of the ceiling formwork frame when connected to the ceiling formwork frame. Thanks to the lack of protrusions, the safety when installing and removing formwork and the quality of the cast ceiling element are increased.

In addition, the holder preferably comprises a holding ridge which protrudes upwards from the bearing face. The holding ridge preferably comprises in each case one section along the two transverse sides and two longitudinal sides of the ceiling formwork frame. It is particularly preferred if the holding ridge extends continuously along the two transverse sides and the two longitudinal sides of the ceiling formwork frame. The wall thickness of the lost ceiling panel corresponds substantially to the height (i.e. the vertical extent) of the holding ridge, so that the upper face (i.e. the side facing the concrete) of the lost ceiling panel terminates substantially flush with the upper face of the holding ridge.

Preferably, the lost ceiling panel is arranged loosely in the holder of the ceiling formwork frame. A secure arrangement on the ceiling formwork frame can be ensured owing to the lost ceiling panel's own weight.

In order to facilitate the construction of the ceiling formwork for preparing the casting or concreting of the ceiling element, it is favourable for the ceiling formwork frame to be held automatically (i.e. independently) in the intermediate position, with the second end region of the ceiling formwork frame together with the lost ceiling panel being spaced from the floor. This means that the ceiling formwork frame can be positioned in the intermediate position without manual support of the second end region (and without putting the second end region down on the floor) before the ceiling formwork frame is pivoted via the second end region thereof upwards into the use position. To this end, the ceiling formwork frame can comprise, on opposing longitudinal sides, supporting sections or support sockets in which corresponding pegs or lugs on the heads of the ceiling supports are received and held when the ceiling formwork frame is in the intermediate position inclined to the horizontal.

In an alternative embodiment, in particular with low room heights, the second end region of the ceiling formwork frame can be put down on the floor when in the intermediate position.

To effect the pivoting up of the ceiling formwork frame together with the lost ceiling panel from the floor, it is advantageous if the second end region of the ceiling formwork frame together with the lost ceiling panel is pivoted up from the intermediate position using an installation pole. The installation pole can comprise, on a free end, an engagement element which can be brought into engagement with a transverse frame element on the second end region in order then to move the ceiling formwork frame upwards with the aid of the installation pole.

In order to guarantee safety during work on the lost ceiling panel before casting, an anti-lift means is preferably provided between the ceiling supports and the ceiling formwork frame, with which anti-lift means the ceiling formwork frame is secured in the pivoted-up position of the ceiling formwork frame against being lifted off the ceiling supports. A corresponding anti-lift means can be provided between the further ceiling supports and the ceiling formwork frame. The anti-lift means preferably comprises a holding lug on the ceiling support (or alternatively on the ceiling formwork frame) and a holding flange on the ceiling formwork frame (or in the alternative embodiment on the ceiling support), which can be brought into engagement with each other when the ceiling formwork frame is pivoted up, such that a vertical relative movement between the holding lug and the holding flange is blocked.

To absorb load during casting of the ceiling element, it is favourable if the ceiling formwork frame comprises two longitudinal sides and two transverse sides, wherein at least one transverse rib extending substantially in the direction of the transverse sides being provided. Preferably, multiple transverse ribs or transverse beams which are spaced from each other in the longitudinal direction of the ceiling formwork frame, in particular running parallel to one another, are provided. Preferably, the ceiling formwork frame is elongate in the longitudinal direction (i.e. in the direction of the longitudinal sides).

To produce ceiling elements of large area, in a preferred embodiment, at least two ceiling formwork frames, each with a lost ceiling panel, are arranged next to each other in the pivoted-up position before the ceiling element together with the lost ceiling panels is cast onto the ceiling formwork frame. Preferably, two adjacent longitudinal sides or transverse sides of two ceiling formwork frames can be supported on two common ceiling supports.

In a particularly preferred embodiment, an interstice between mutually facing side faces of the lost ceiling panels is filled with a filling compound after casting of the ceiling element. The interstice is in particular designed as a negative shape of adjacent holding ridges of the ceiling formwork frames. By filling the interstice after concreting, a substantially flat lower face of the ceiling element can be achieved. It is particularly advantageous that the subsequent work on the ceiling element can be completed particularly simply and quickly. When ceiling elements are produced with reusable formwork, however, it is often necessary to scrape off protruding concrete beads or concrete burrs (i.e. excess concrete material) in the region of adjacent shuttering panels in order to produce a flat lower face. However, in the method described above, the interstice can be filled with filling compound such as filling paste with much less effort. When a concrete burr or a concrete tag occurs in the interstice between the lost ceiling panels during concreting, it can be concealed inside the filling compound.

In a further preferred embodiment, a sealing strip is arranged along adjacent edge regions on the upper faces of the lost ceiling panels before casting. The sealing strip in particular makes it possible to cover the gaps between the lost ceiling panels owing to tolerances and to prevent dirtying of the lower ceiling surface. Depending on the embodiment, a gap between the lost ceiling panel and the ceiling formwork frame can also be closed. The pivoting down of the frame can also be facilitated.

Preferably, the ceiling formwork frame comprises an elevation, i.e. an upward bend, along the longitudinal sides and/or transverse sides thereof. The elevation can for example be a few millimetres to centimetres. The lost ceiling panel can thereby be present in an upwardly curved state when in the use position, wherein the panel preferably being arranged on bearing faces in the ceiling formwork frame for the lost ceiling panel. This allows a slight curve to be formed in the cast or resulting ceiling, as a result of which subsequent, statically induced settlement of the finished ceiling can easily be compensated without further activity. This elevation allows a substantial weight reduction in the dimensioning of the ceiling formwork frame with regard to the flatness of the finished ceiling element.

After the ceiling element of the ceiling formwork frames has cured, the ceiling supports or the at least one further ceiling support can be removed or transferred to an inclined rest position. The ceiling formwork frame can then be arranged in the intermediate position. The ceiling formwork frame can then be detached and removed from the ceiling supports, which remain in the supporting position.

The ceiling formwork for producing the ceiling element comprises at least

- two ceiling supports for supporting a first end region of a ceiling formwork frame such that the ceiling formwork frame can be arranged in an intermediate position inclined downwards from the first end region in the direction of a second end region,
- two further ceiling supports for supporting the second end region of the ceiling formwork frame in a pivoted-up position of the ceiling formwork frame, and
- a lost ceiling panel on the ceiling formwork frame.

Of course, the ceiling formwork can comprise further ceiling formwork frames, ceiling supports and lost ceiling panels, depending on the application.

The invention is explained in more detail below using preferred exemplary embodiments.

DETAILED DESCRIPTION

Figure 1:
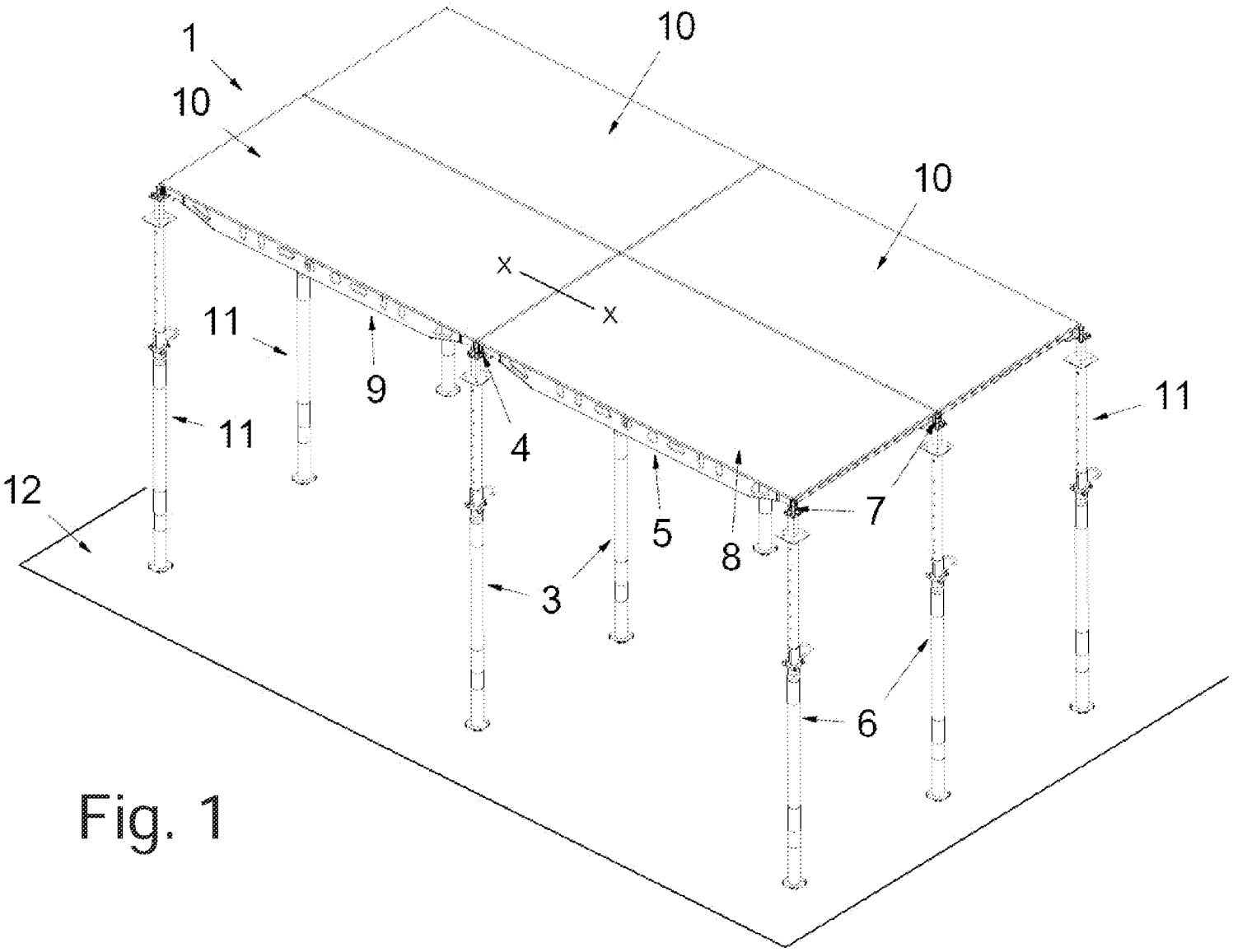
FIG. 1 shows a view of a ceiling formwork having four ceiling formwork frames together with lost ceiling panels in the horizontal use position or formwork installation position thereof.
Figure 12:
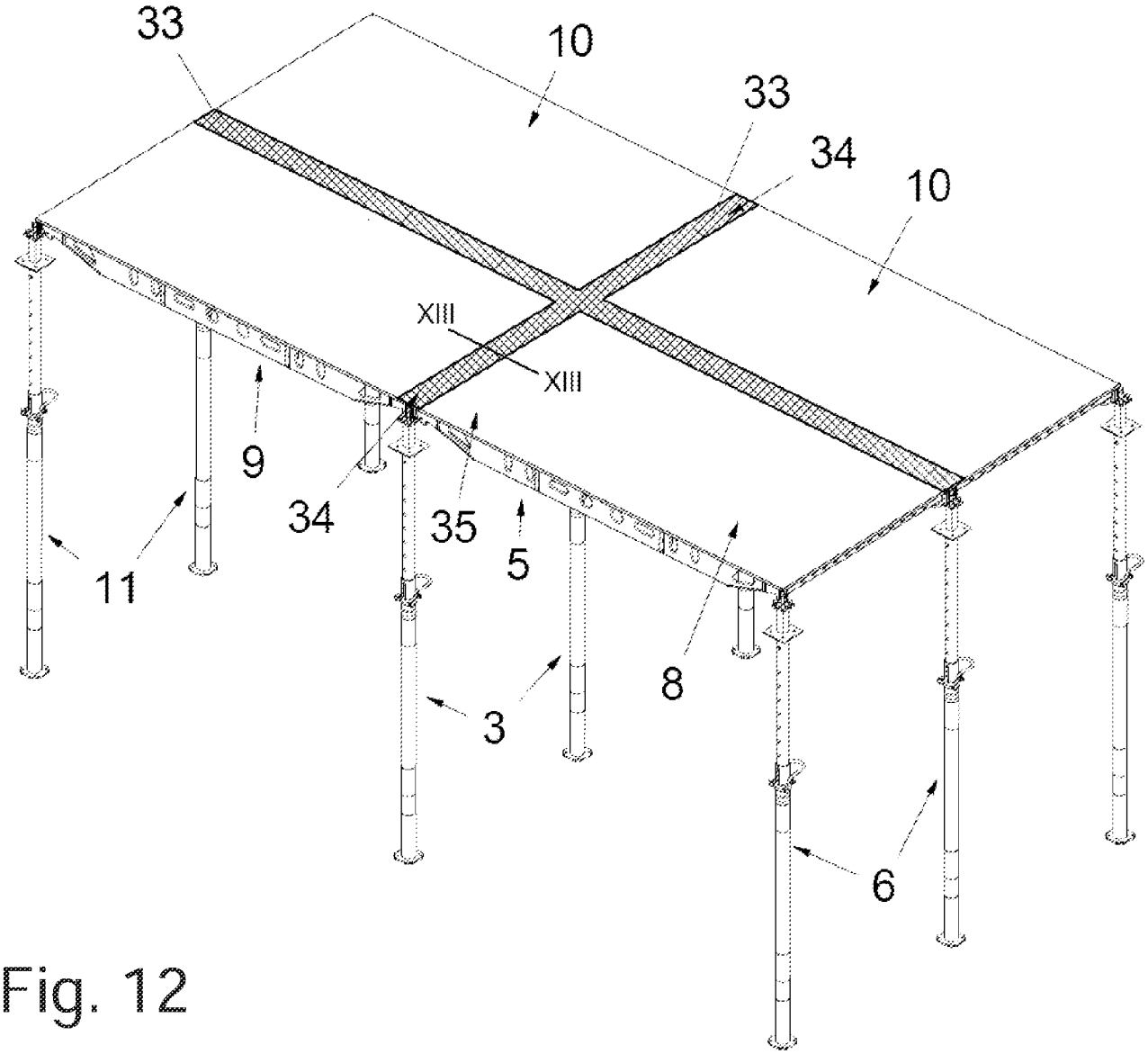
FIG. 12 shows a view corresponding to FIG. 1 of an alternative embodiment of the ceiling formwork, in which the mutually adjacent edge regions of the lost ceiling panels are provided with sealing strips before casting.
Figures 13, 14:
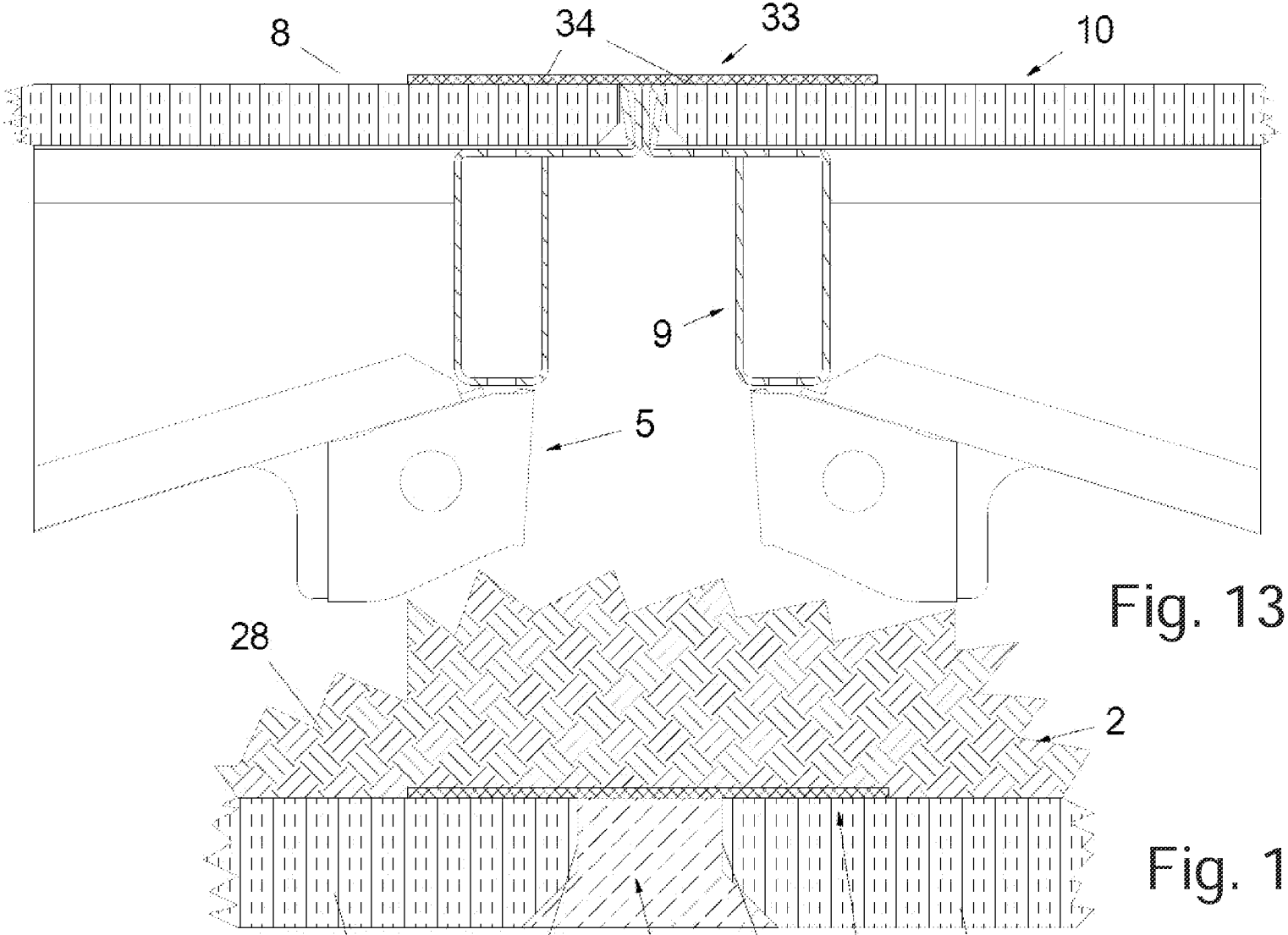
FIG. 13 shows a sectional view along the line XIII-XIII in FIG. 12.
FIG. 14 shows a detail of the ceiling element which is obtained when the ceiling formwork of FIGS. 12 and 13 is used.

FIG. 1 shows a ceiling formwork 1 for concreting a ceiling element 2 (see FIGS. 12 and 14). The ceiling formwork 1 comprises two ceiling supports 3 for supporting a first (longitudinal) end region 4 of a ceiling formwork frame 5 and two further ceiling supports 6 for supporting a second end region 7 of the ceiling formwork frame 5. On the ceiling formwork frame 5 there is arranged a lost ceiling panel 8 which therefore remains in the ceiling formwork element 2 after concreting. Accordingly, the ceiling panel 8 is designed in the form of a lost formwork.

In the exemplary embodiment shown, the ceiling formwork 1 comprises three further ceiling formwork frames 9 on which further lost ceiling panels 10 are arranged. The further ceiling formwork frames together with further lost ceiling panels 10 are supported on additional ceiling supports 11. Preferably, the further ceiling formwork frames 9 are designed correspondingly to the ceiling formwork frame 5, and the further lost ceiling panels 10 are designed correspondingly to the lost ceiling panel 8. The ceiling supports 3, further ceiling supports 6 and additional ceiling supports 11 can likewise be designed identical.

The construction of the ceiling formwork 1 can be seen in FIGS. 2 to 5.

In the first step, the two ceiling supports 3 are supported on a floor 12 (cf. FIG. 1), which is formed for example by the underlying story of a building to be erected using the ceiling formwork 1. Such ceiling supports 3 are well-known in the prior art. In the embodiment shown, each ceiling support 3 comprises an upper ceiling support part 13 and a lower ceiling support part 14, which are adjustable relative to each other in the vertical direction in order to set the height (i.e. the vertical extent) of the ceiling support 3 depending on the application. The ceiling support 3 comprises a bolting device 15 for bolting the upper ceiling support part 13 into different height positions relative to the lower ceiling support part 14. The bolting device 15 can comprise a bracket 16 which can be inserted through corresponding holding openings 17 spaced from each other in the vertical direction in the upper ceiling support part 13. At the upper end region of the ceiling support 3 there is also provided a head part 18, which is designed for detachable connection to the first end region 4 of the ceiling formwork frame 5. In addition, an anti-lift means can be provided on the heads of the ceiling supports 3 on which the ceiling formwork frame 5 is supported, with which the ceiling formwork frame 5 is secured in the pivoted-up position of the ceiling formwork frame 5, against lifting off from the ceiling supports 3.

Figure 2:
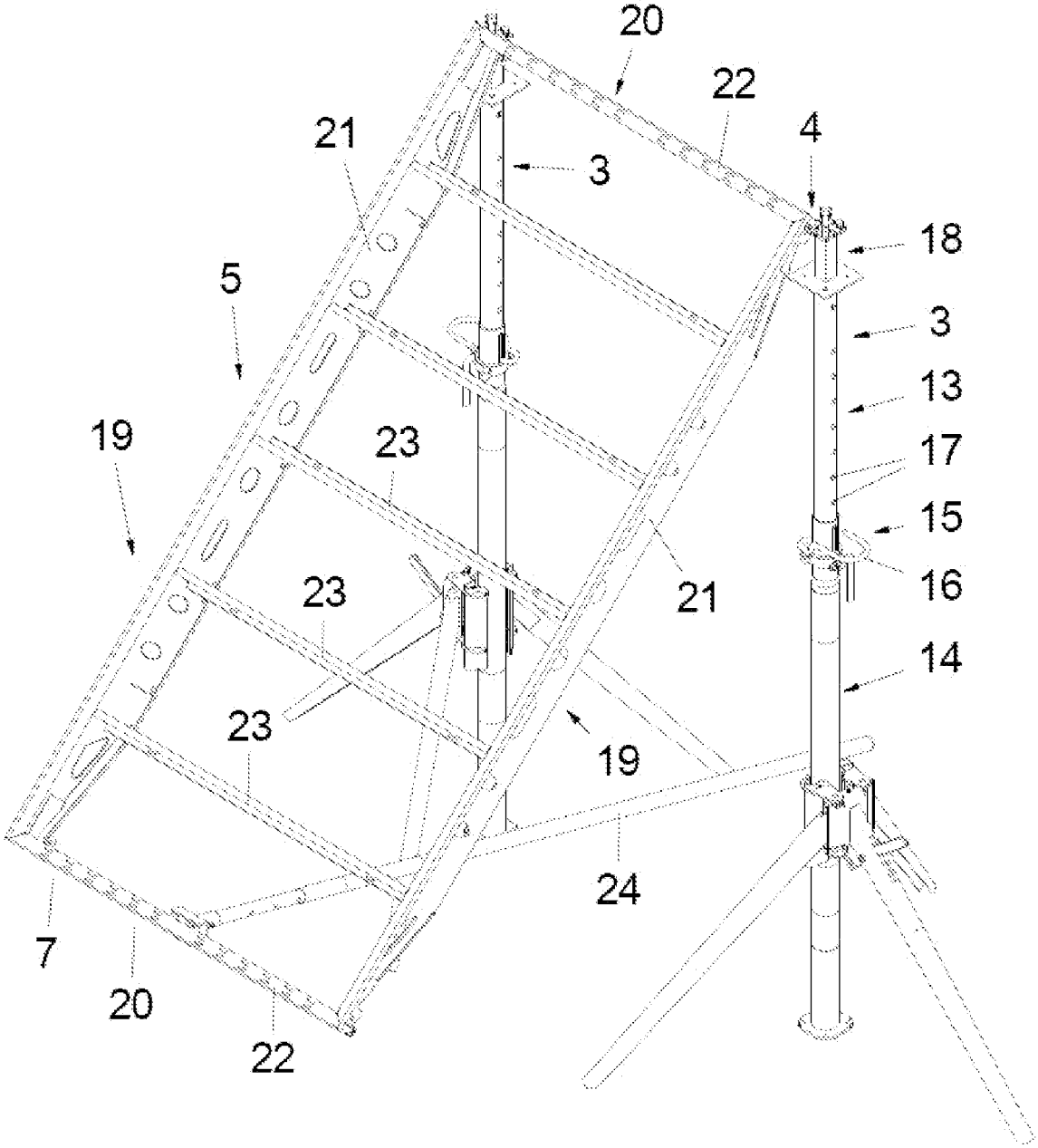
FIG. 2 shows one of the ceiling formwork frames in an intermediate position during construction of the ceiling formwork according to FIG. 1, wherein the first end region of the ceiling formwork frame is connected to two ceiling supports, while the second, opposite end region of the ceiling formwork frame is in the vicinity of the floor.
Figure 3:
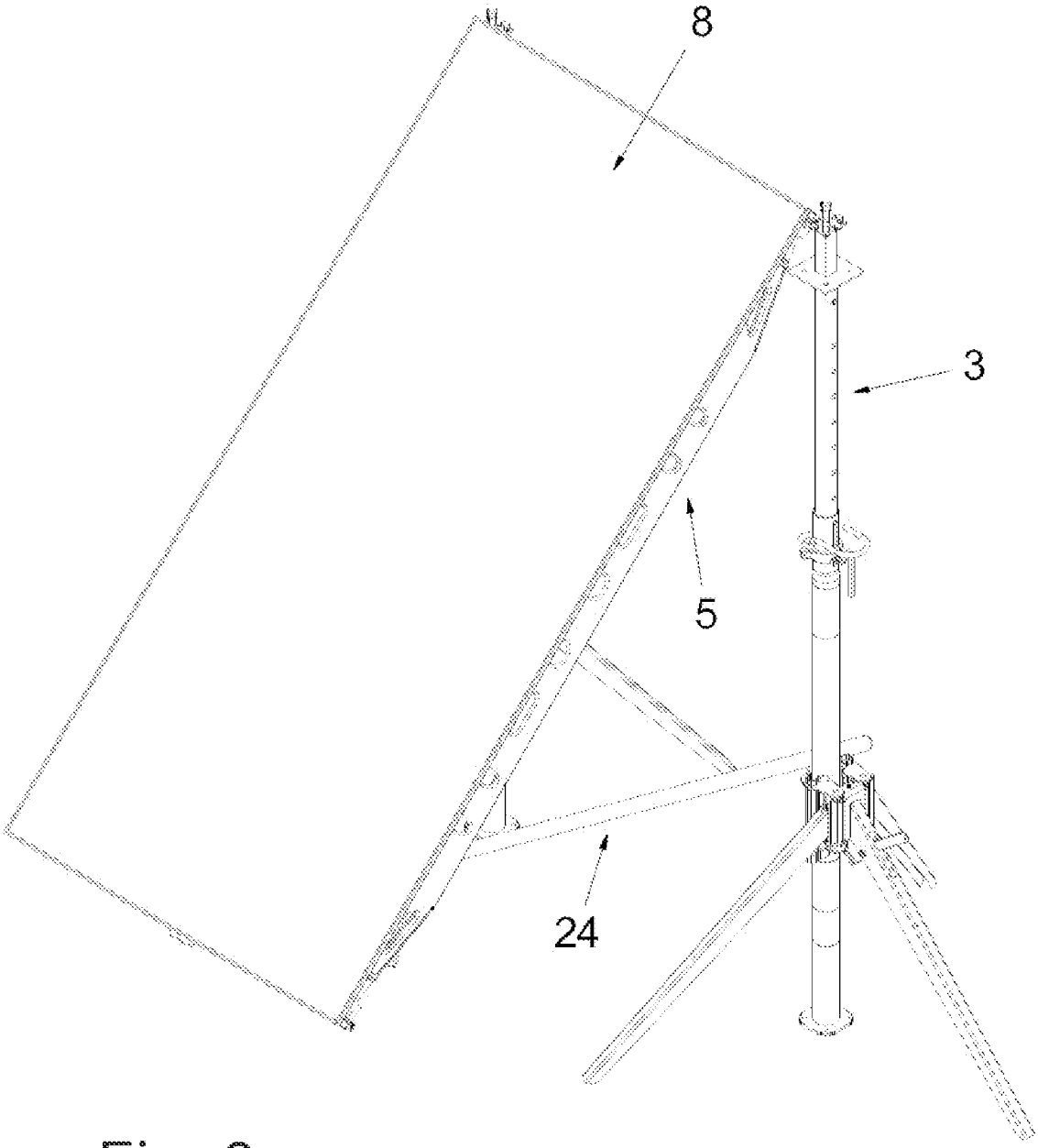
FIG. 3 shows the ceiling formwork frame according to FIG. 2 after the lost ceiling panel has been laid.
Figure 6:
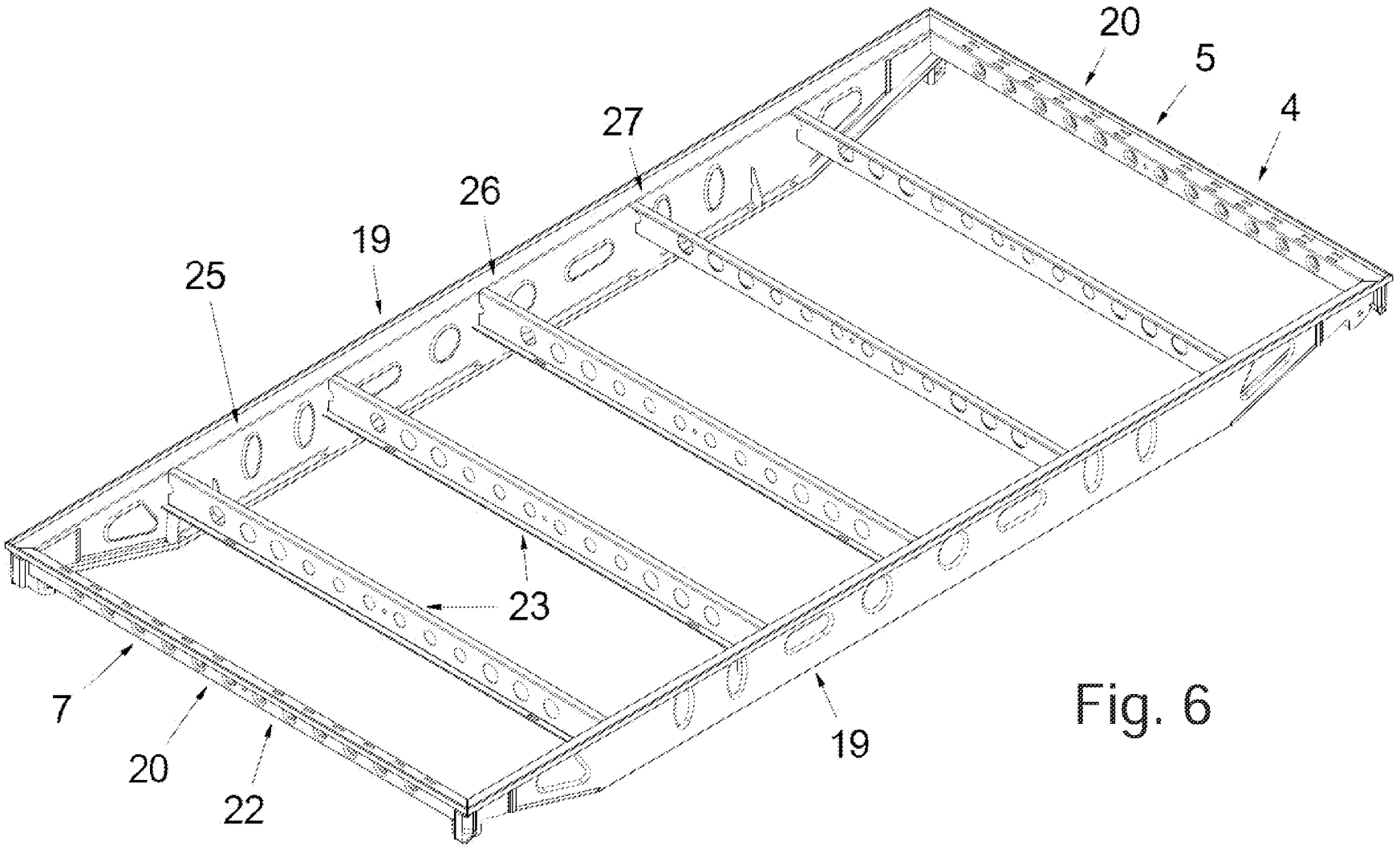
FIG. 6 shows a view of the ceiling formwork frame without a lost ceiling panel.
Figure 7:
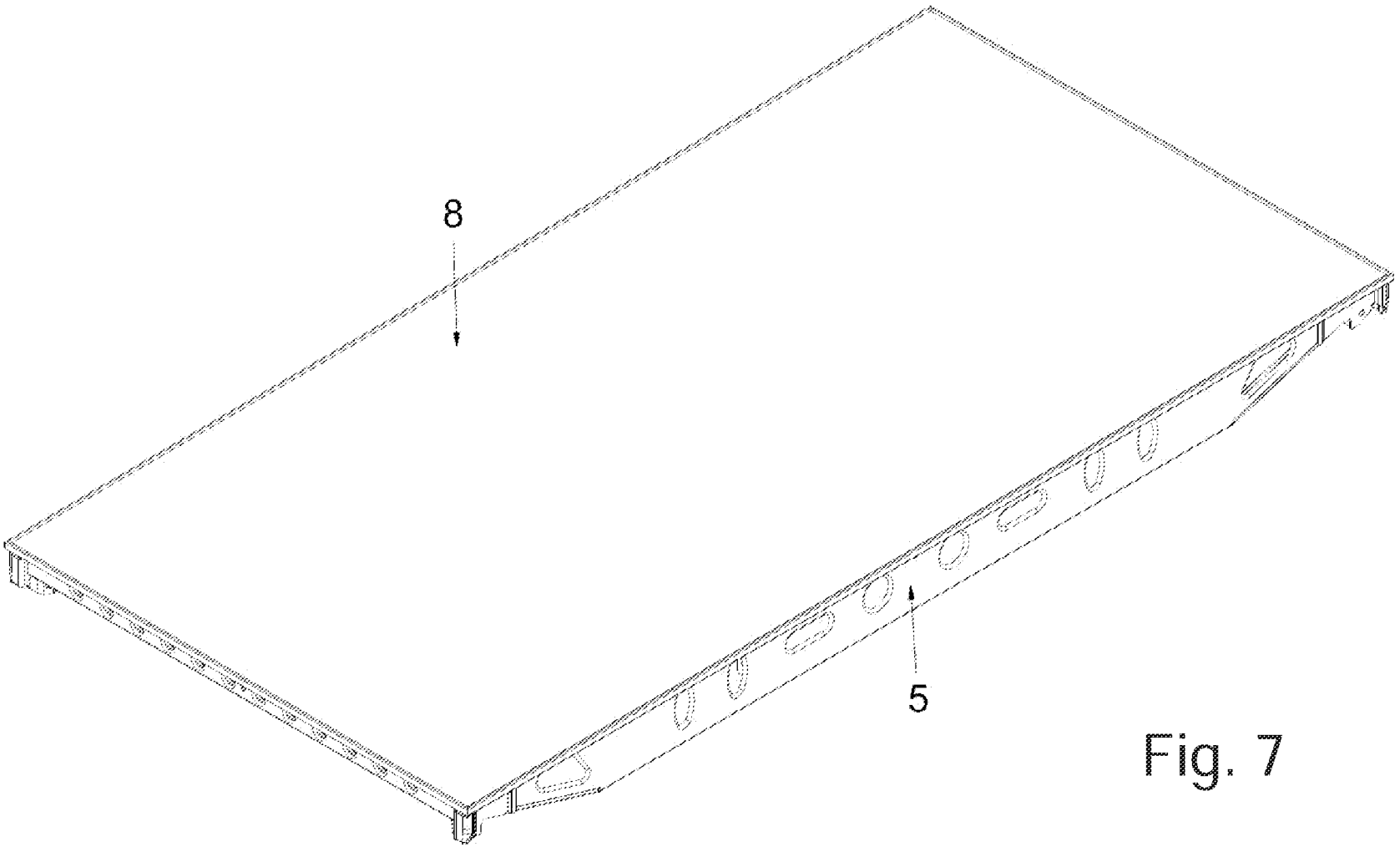
FIG. 7 shows a view of the ceiling formwork frame with a lost ceiling panel.
Figure 8:
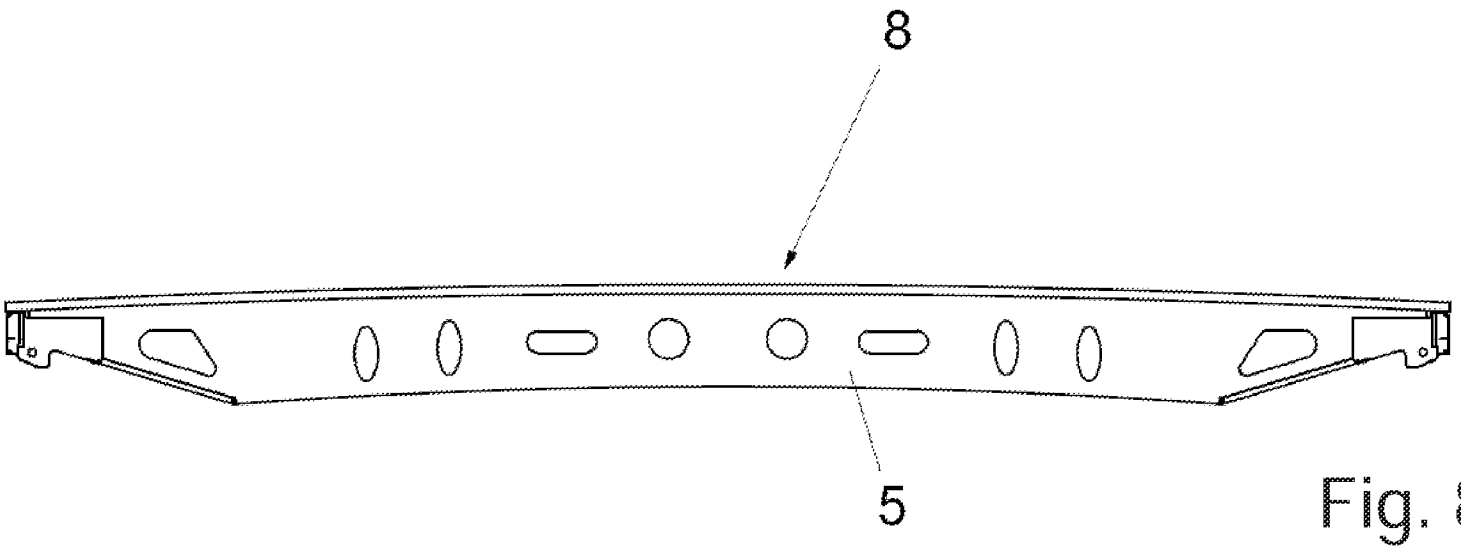
FIGS. 8 and 9 show side views of the ceiling formwork frame with a lost ceiling panel.
Figure 9:
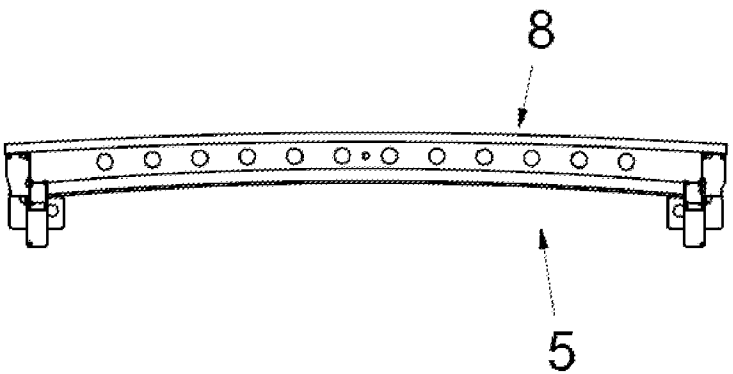

As can be seen in particular in FIGS. 2 and 6, the ceiling formwork frame 5 in the embodiment shown is designed rectangular with two opposing longitudinal sides 19 and two opposing transverse sides 20 when viewed from above. There are longitudinal frame parts 21 on the longitudinal sides 19 and transverse frame parts 22 on the transverse sides 20. Furthermore, the ceiling formwork frame 5 comprises multiple transverse ribs 23, which extend parallel to the transverse frame parts 22 on the transverse sides 20 of the ceiling formwork frame 5.

After the ceiling supports 3 have been arranged in the vertical supporting position on the floor 12, the first end region 4 of the ceiling formwork frame 5 is fitted (hooked) into the head parts 18 of the ceiling supports 3. In the process, the ceiling formwork frame 3 is arranged in an intermediate position inclined downwards starting from the first end region 4 towards the second end region 7. The ceiling formwork frame 5 can be held automatically (independently) in the intermediate position, depending on the embodiment.

Figure 10:
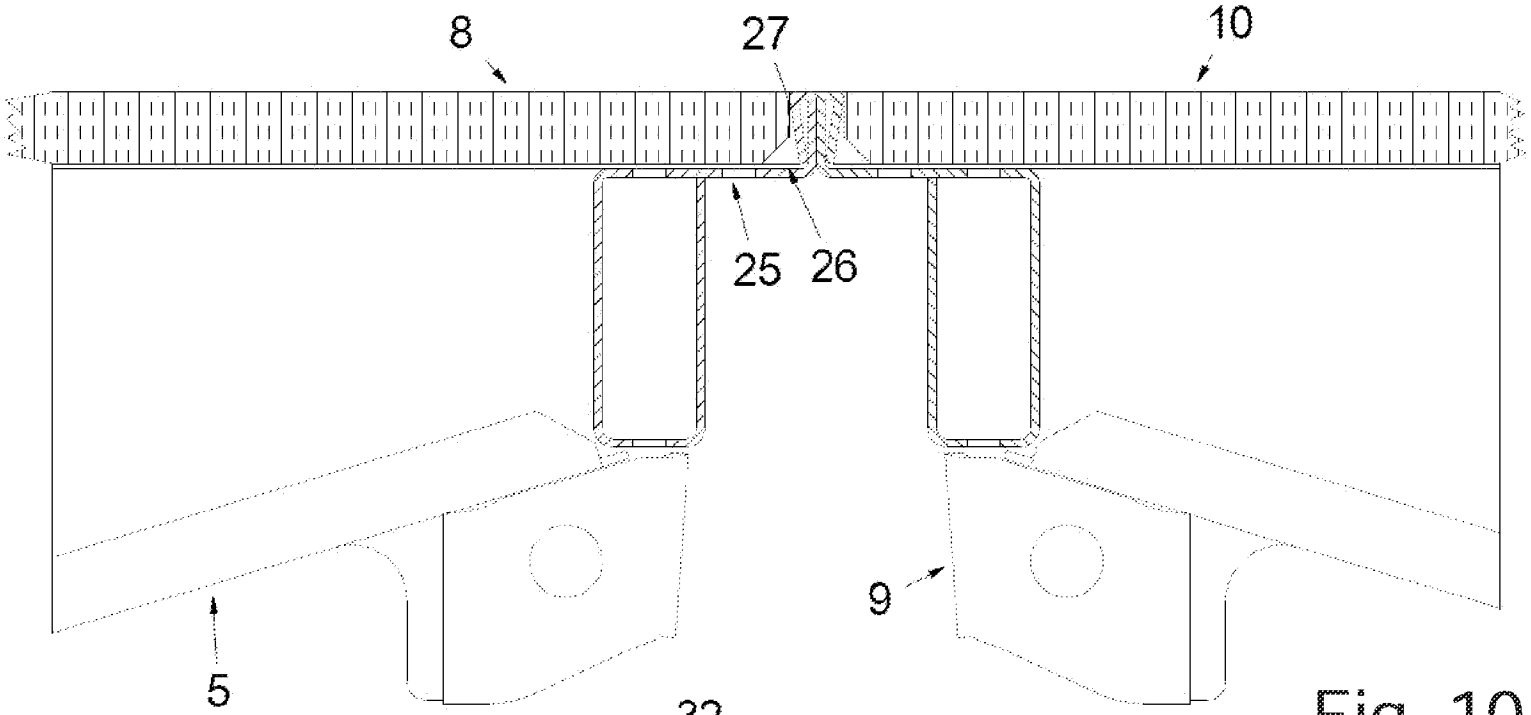
FIG. 10 shows a sectional view along the line X-X in FIG. 1.

In the next step (cf. FIG. 3), the lost ceiling panel 8 is connected to the ceiling formwork frame 5 which is arranged in the intermediate position. To this end, the lost ceiling panel 8 is placed into a holder 25 of the ceiling formwork frame 5, which holder 25 can be seen in detail in FIGS. 6 and 10. The holder 25 comprises a bearing face 26 on which the lost ceiling panel 8 is placed and a holding ridge 27 for enclosing the lost ceiling panel 8 on the longitudinal and/or transverse sides.

Figure 4:
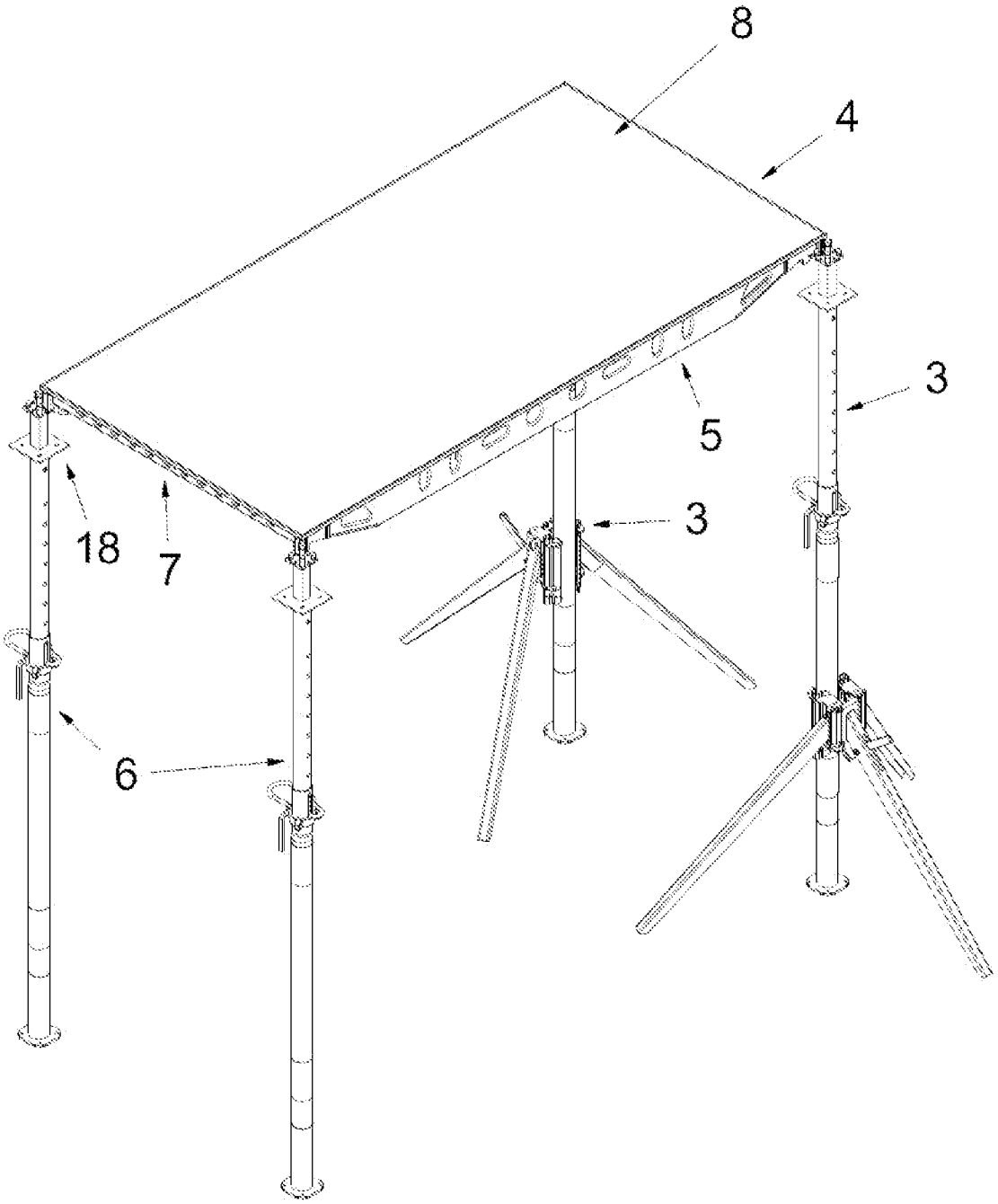
FIG. 4 shows the ceiling formwork frame according to FIGS. 1 to 3 in the pivoted-up use position supported on four ceiling supports in total.

In the next step, the ceiling formwork frame 5 together with the lost ceiling panel 8 is pivoted up into the horizontal use position according to FIG. 4 with the aid of the installation pole 24. The second end region 7 of the ceiling formwork frame 5 is supported with the two further ceiling supports 6. To this end, the head parts 18 of the further ceiling supports 6 are connected to the second end region 7 of the ceiling formwork frame 5.

Figure 5:
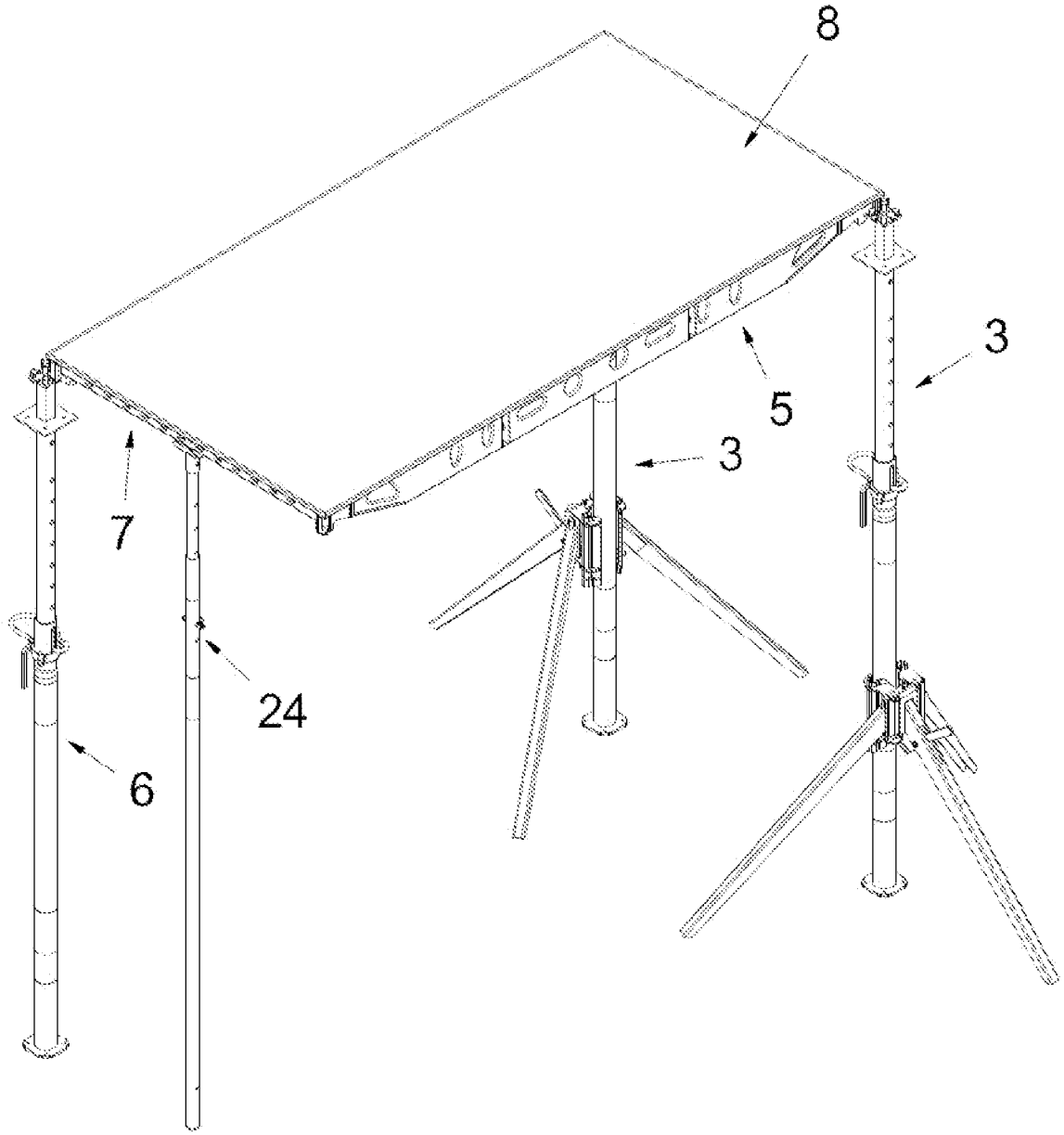
FIG. 5 shows a variant in which the second end region of the ceiling formwork frame in the pivoted-up position is initially supported only at one corner region with the first of the two further ceiling supports, in order to bring an adjacent further ceiling formwork frame into the same position first and then to use the second of the two further ceiling supports to support the adjacent corner region of the ceiling formwork frames.

FIG. 5 shows a further intermediate position of the ceiling formwork frame 5, which is preferably assumed when at least two ceiling formwork frames 5 are positioned next to one another (as shown in FIG. 1). In this embodiment, the second end region 7 of the ceiling formwork frame 5 is initially supported in the pivoted-up position only with the first of the two further ceiling supports 6 and preferably secured with the aid of the installation pole 24. The adjacent further ceiling formwork frame 9 is then arranged in the pivoted-up position. Finally, the second of the further ceiling supports 6 is connected to the free corner regions of the ceiling formwork frame 5 or of the further ceiling formwork frame 9.

Figure 11:
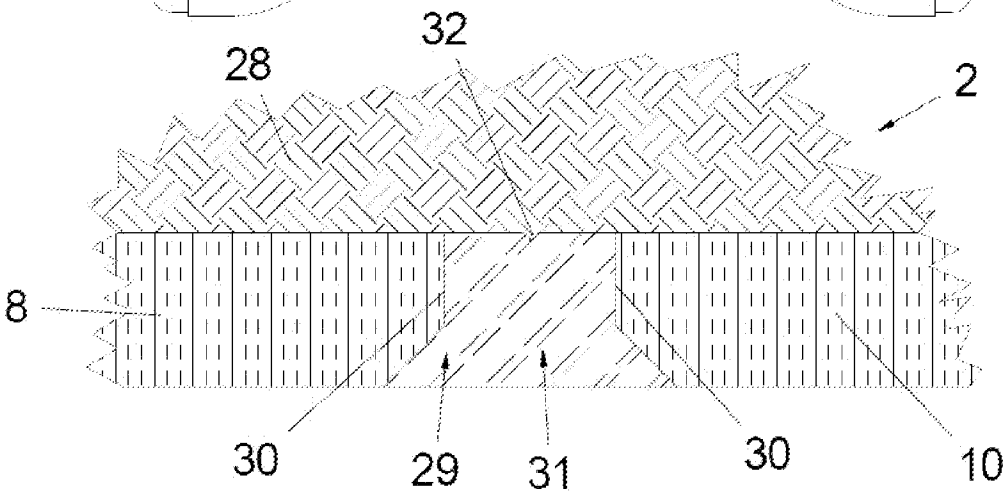
FIG. 11 shows the ceiling element after the casting process, wherein an interstice between two lost ceiling panels has been filled with filling compound.

In this manner, the ceiling formwork 1 is constructed as shown in FIG. 1. In the use position, the ceiling element 2 including the lost ceiling panel 8 (and, depending on the embodiment, a number of further ceiling panels 10) is finally cast. The ceiling element 2 therefore comprises an upper concrete layer 28, on the lower face of which the lost ceiling panel 8 (and any further ceiling panels 10; cf. FIG. 11) is arranged. To ensure a permanent bond between the lost ceiling panel 8 and the concrete layer 28, the ceiling panel 8 preferably comprises a material which itself bonds to the concrete of the concrete layer 8 in the liquid state. Alternatively, the ceiling panel 8 can comprise a roughened upper face or surface structures forming depressions or elevations, e.g. lugs, by means of which the ceiling panel 8 is held with the concrete layer 28 by a form fit.

During concreting, an interstice 29 is formed between mutually facing side faces 30 of the lost ceiling panels 8, 10. After the ceiling element 2 has been cast, the interstice 29 can be filled with a filling compound 31 (see FIGS. 11 and 14). The advantage of this is that a concrete burr 32 in the butt join region of adjacent ceiling formwork frames 5, 9 can be concealed inside the filling compound 31 so that laborious scraping off of the concrete bead 32, as is the case for a reusable formwork with multiple butt-joined shuttering panels, can be omitted.

FIGS. 12 to 14 show an alternative variant; only the differences from the variant of FIGS. 1 to 11 are explained below.

In this embodiment, at least one sealing strip 33 is arranged only along adjacent edge regions 34 on the upper faces 35 of the lost ceiling panels 8, 10 before the ceiling element 2 is cast. The sealing strip 33 therefore bridges the interstice 29.

The invention claimed is:

1. A method for producing a ceiling element, having the following steps:

arranging two ceiling supports on a floor, connecting a first end region of a ceiling formwork frame to the two ceiling supports such that the ceiling formwork frame is arranged in an intermediate position inclined downwards from the first end region in a direction of a second end region, connecting a lost ceiling panel to the ceiling formwork frame arranged in the intermediate position, pivoting up the second end region of the ceiling formwork frame together with the lost ceiling panel, supporting the second end region of the pivoted-up ceiling formwork frame with at least one further ceiling support, and casting the ceiling element together with the lost ceiling panel on the ceiling formwork frame.

2. The method according to claim 1, wherein the lost ceiling panel is placed into a holder of the ceiling formwork frame for connection to the ceiling formwork frame.

3. The method according to claim 1, wherein the ceiling formwork frame is held automatically in the intermediate position, wherein the second end region of the ceiling formwork frame together with the lost ceiling panel is spaced from the floor.

4. The method according to claim 1, wherein the second end region of the ceiling formwork frame together with the lost ceiling panel is pivoted up from the intermediate position using an installation pole.

5. The method according to claim 1, wherein an anti-lift means is provided between the ceiling supports and the ceiling formwork frame, with which anti-lift means the ceiling formwork frame is secured in the pivoted-up position of the ceiling formwork frame, against lifting off from the ceiling supports.

6. The method according to claim 1, wherein the ceiling formwork frame comprises two longitudinal sides and two transverse sides, wherein at least one transverse rib extending substantially in the direction of the transverse sides is provided.

7. The method according to claim 1, wherein at least two ceiling formwork frames, each with a respective lost ceiling panel, are arranged next to each other in the pivoted-up position before the ceiling element together with the lost ceiling panels is cast onto the ceiling formwork frames.

8. The method according to claim 7, wherein an interstice between mutually facing side faces of the respective lost ceiling panels is filled with a filling compound after casting of the ceiling element.

9. The method according to claim 7, wherein a sealing strip is arranged along adjacent edge regions on the upper faces of the respective lost ceiling panels before casting.

10. The method according to claim 1, wherein the ceiling formwork frame is brought into the intermediate position after the ceiling element has cured.

11. The method according to claim 6, wherein the ceiling formwork frame comprises an elevation along at least one of the longitudinal sides and the transverse sides.

* * * * *